US005197523A

United States Patent [19]

Fink, Jr. et al.

[11] Patent Number: 5,197,523

[45] Date of Patent: Mar. 30, 1993

[54] DISPENSING NOZZLE IMPROVEMENT FOR EXTRACTING FUEL

[75] Inventors: Arthur C. Fink, Jr., Lonedell; Thomas O. Mitchell, Maryland Heights, both of Mo.

[73] Assignee: Husky Corporation, Pacific, Mo.

[21] Appl. No.: 740,062

[22] Filed: Aug. 5, 1991

[51] Int. Cl.[5] ..... B67D 5/06

[52] U.S. Cl. ..... 141/206; 141/46; 141/59; 141/217; 141/226

[58] Field of Search ..... 141/206–229, 141/44–46, 59

[56] References Cited

U.S. PATENT DOCUMENTS

| | | | |
|---|---|---|---|
| 4,429,725 | 2/1984 | Walker et al. | 141/59 |
| 4,566,504 | 1/1986 | Furrow et al. | 141/59 |
| 4,570,686 | 2/1986 | Devine | 141/59 X |
| 4,687,033 | 8/1987 | Furrow et al. | 141/59 |
| 4,749,009 | 6/1988 | Faeth | 141/45 |
| 4,951,720 | 8/1990 | Graitham | 141/44 |
| 5,035,271 | 6/1991 | Carmack et al. | 141/206 |
| 5,040,577 | 8/1991 | Pope | 141/59 |

FOREIGN PATENT DOCUMENTS

| | | | |
|---|---|---|---|
| 155186 | 9/1985 | European Pat. Off. | 141/44 |

*Primary Examiner*—Ernest G. Cusick
*Attorney, Agent, or Firm*—Paul M. Denk

[57] ABSTRACT

A fuel dispensing nozzle (10) has a body (12) including a fuel passage for fuel to flow from a source thereof through the body. A spout (18) is attached to the body in fluid communication therewith for fuel to flow into the spout from the passage. The distal end of the spout forms a mouth (19) insertable into the tank. A vapor return path is provided for capturing fuel vapors and returning them to the source, so to substantially reduce or eliminate emissions. A vacuum is produced in a variable venturi portion (42) of the nozzle and is applied to the return path to extract any fuel collecting therein. This vacuum is in addition to another vacuum produced at the venturi and used to assist in automatically shutting-off fuel flow when the tank is full. This device is a power generating source that is not limited to only fuel extraction and nozzle shut off. It can also be used for other apparent uses, having the multiple usage applied in conjunction with the vapor recovery systems in the category of the balanced pressure system and the vacuum assist system.

7 Claims, 4 Drawing Sheets

DISPENSING NOZZLE IMPROVEMENT FOR EXTRACTING FUEL

BACKGROUND OF THE INVENTION

This invention relates to fuel dispensing nozzles of the type used to dispense gasoline for automobiles and the like, and more particularly, to an improvement to such a nozzle assembly by which fuel which condenses in a vapor return hose of the nozzle assembly can be readily extracted and returned to the fuel source to help reduce atmospheric pollution.

Gasoline dispensing nozzles of the type found in most service stations employ a spout insertable into the inlet of the filler pipe of an automobile's fuel tank. Because of environmental concerns, it is now a requirement in many locales that fuel dispensing nozzles be designed so fuel vapors which previously were allowed to escape into the atmosphere during filling are captured and returned to the fuel source. For this purpose, nozzles are equipped with a flexible bellows assembly which fits over the spout. The end of the bellows fits snugly against the mouth of the pipe so there is no opening for gasoline vapors to escape. See, for example, U.S. Pat. Nos. 4,031,930, and 4,016,910, which are assigned to Husky Corporation, the same assignee as the present application.

To return fuel vapors back to the source, the nozzle assembly is equipped with a vapor return line. However, fuel vapors occasionally condense in this line, and the condensed fuel needs to be drawn off or else the vapor return passage will be blocked and not work as intended. Various attempts have been made to correct this problem, but there is still a need for a simple, reliable, and cost effective solution.

Generally, there are a variety of methods by which vapors from gasoline are captured, and returned usually back to the underground tank. Thus, by utilizing means for achieving such, the vapors are prevented from escaping to the surrounding atmosphere, and are returned to the storage tank. Usually, vapor recovery systems are of two types. One is the vacuum assist system, that utilizes the generation of a partial vacuum created within the nozzle, by means of the flowing fuel passing through the nozzle during its dispensing, and this partial vacuum has a tendency to attract vapors back into the nozzle, either through a bellows arrangement used in conjunction with the nozzle spout, or through passage created between concentrically arranged nozzle spouts, which allows the partial vacuum to attract the vapors back into the spout, for return to, usually, the underground storage tank. A second system utilizes what is generally identified as the balanced pressure system, whereby when gasoline is pumped into the automobile fuel tank, the displaced air is forced back towards the emplaced nozzle, and forces the gasoline vapors to be captured and passed through the bellows type boot, for forced return back into the fuel line, and eventually back to the underground storage tank.

Examples of patents that disclose these types of systems, as previously reviewed, include the Walker U.S. Pat. No. 4,429,725, which shows the vacuum assist vapor recovery system, in addition to the Polson U.S. Pat. No. 4,351,375, which utilizes the direct force of the flow of the dispensed fluid to regulate the opening or closing of a vapor passageway, rather than the peripheral pressure generated by the fluid to attain such. The Pyle U.S. Pat. No. 4,232,715, discloses the use of concentrically formed nozzle spout, including vapor passageway, and which opens the vapor-recovery valve through the actuation of a plunger caused when the fill pipe of the vehicle has the nozzle pressed against it, when inserted for filling of the fuel tank. Other patents relating to vacuum assist for removing vapors include the McGahey U.S. Pat. No. 4,223,706, in addition to the Lasater U.S. Pat. No. 4,199,012.

SUMMARY OF THE INVENTION

Among the several objects of the present invention may be noted the provision of an improvement in a fuel dispensing nozzle; the provision of such an improvement by which fuel condensing in a vapor return hose of the nozzle assembly can be extricated and extracted; the provision of such an improvement by which fuel at a depth below the nozzle can be extracted from the hose during normal filling operations; the provision of such an improvement which performs such removal without affecting other nozzle functions; the provision of such an improvement by which different vacuums are created within the nozzle assembly, one of which is for vapor recovery and fuel extraction and another of which is for shutting off fuel flow when a container being filled is full; and, the provision of such an improvement by which the various vacuums are isolated from each other so as not to affect the respective functions for which the vacuums are created.

In accordance with the invention, generally stated, a fuel dispensing nozzle has a body including a fuel passage for fuel to flow from a source thereof through the body. A spout is attached to the body in fluid communication therewith for fuel to flow into the spout from the passage. The distal end of the spout forms a mouth insertable into the tank. A vapor return path is provided for capturing fuel vapors and returning them to the source, so to substantially reduce or eliminate emissions. A vacuum is produced in a variable venturi portion of the nozzle and is applied to the return path to extract any fuel condensing therein. This vacuum is in addition to a second vacuum produced at the venturi and which is used to automatically shut-off fuel flow when the tank is full. Other objects and features are in part apparent and in part pointed out hereinafter.

BRIEF DESCRIPTION OF THE DRAWINGS

In referring to the drawings.

Corresponding reference characters indicate corresponding parts throughout the drawings.

DESCRIPTION OF THE PREFERRED EMBODIMENT

Figures 1, 1A, 2:
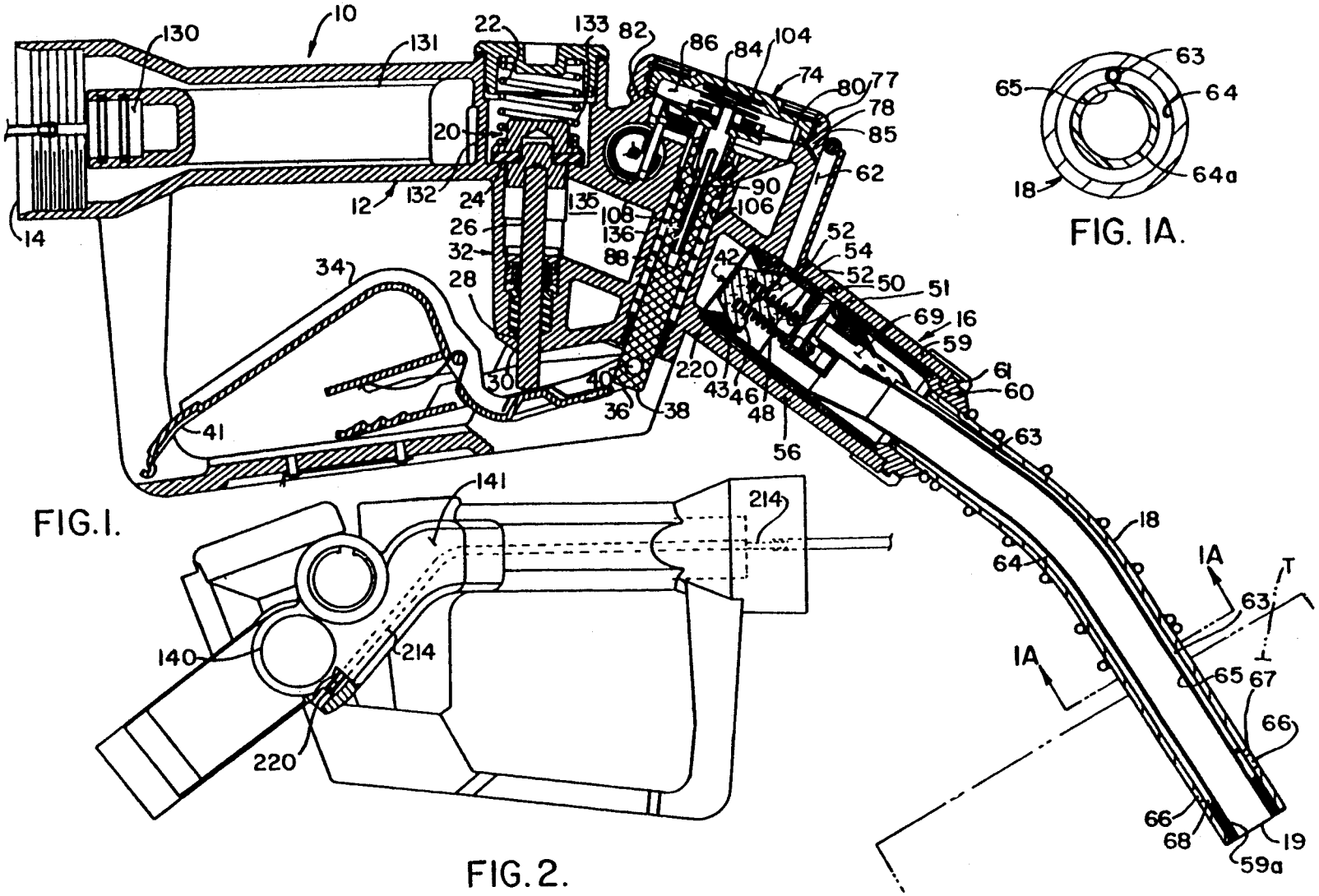
FIG. 1 is a sectional view of a nozzle assembly of the vacuum assist system type embodying the improvement of the present invention.
FIG. 1A is a sectional view of the spout taken along the line 1A—1A of FIG. 1.
FIG. 2 is a left side view of the nozzle body assembly, without the spout, showing the condensed fuel return line.

Referring to the drawings, a nozzle for dispensing liquids such as gasoline, diesel fuel or the like is indicated generally 10. The nozzle includes a body 12 having an inlet 14 to which a fuel hose (not shown) is connected. The nozzle also has an outlet 16 communicating with a spout 18 assembly. Assembly 18 has a mouth 19 insertable into the inlet of a container such as an automobile fuel tank, as depicted at T. Disposed within body 12, between the inlet and outlet, is a poppet valve 20. This valve is biased by a spring 22 into sealing engagement with a valve seat 24. Valve 20 is secured to the upper end of a valve stem 26. The valve is located in the upper portion of body 12, and the valve stem extends downwardly through the body. The lower end of the stem projects through an opening 28 in the base 30 of a body section 32. An operating lever 34 for the nozzle has one end 36, its pivoting functional end, connected to the lower end of a plunger 38 by, for example, a pin 40. The other end 41 of the lever is grasped by the hand of a user, and when squeezed, the upward pressure on the lever, forces valve stem 26 upwardly. This moves valve 20 off valve seat 24, opening the valve, and permitting fuel flow through the nozzle.

Adjacent outlet 16 of the nozzle, in the flow path through body 12, is a variable venturi 42. A spring loaded check valve 43 is positioned in the venturi, on the downstream side thereof, so to control fuel flow into the outlet. The check valve has a valve body which is frustoconically shaped and fits into the flow restriction formed by the venturi. Extending from the underside 46 of the valve body is a valve stem 48. This stem is slidingly received in a cylindrically shaped valve guide 50 which projects inwardly into the outlet from an interior wall portion 51 of the spout assembly. An annular groove 52 is formed in underside 46 of the valve body, adjacent stem 48, and extends upwardly into the valve body. The width of this groove is sufficient for a spring 54 to both fit into the groove and seat against the base thereof. Spring 54 also seats against the base of guide 50. When valve 20 is opened, the rush of fuel through the nozzle body unseats the check valve so fuel can flow through the venturi 42 to the nozzle outlet. The flow rate is a function of the extent to which valve 43 is pushed downstream against the force of spring 54.

Venturi 42 is installed in a circular housing 56 which defines outlet 16.

Spout assembly 18 cooperates with the spout housing 59 of the body 12, with the spout housing 59 having an inlet end 60 communicating with outlet 16. The spout 18 is held thereto by fastener 61, which is threadedly engaged thereon. From its inlet end to its mouth, the spout 18 gradually curves along its length so as to facilitate insertion of the spout into the fuel tank inlet, of the fuel tank T, as noted.

The spout 18 has a vent passage 64 located therein, and which is constructed concentrically interiorly of the spout 18, and is formed of an inner cylinder 65 through which the main fuel flow is conducted, and through which the fuel flows through the spout 18, for deposit into the vehicle tank T. The inner concentric vent passage 64 is provided between the concentrically located cylinder 65, and the outer cylinder forming the spout 18, and it is through this vent passage that the fuel vapors are accommodated in their return back to the underground storage tank containing the supply of fuel. The length of this vent passage 64 is less than that of the spout 18, so that said vent passage terminates short of the mouth 19 of the shown spout. A fillet or spacer **59*a* is provided therein, as noted. A series of perimeter disposed openings 66 are formed through the outer end of the spout 18, adjacent its mouth, and just above the fillet, providing for the passage of the vapors through the openings 66, and into the vent passage 64**, for return to storage.

An air passage 62 is formed within the nozzle body, as can be noted, and communicates with the area of the nozzle diaphragm. The air passage 62 communicates with the inner end of a tube 63. The opposite end of the vent tube 63, as can be seen at 67, is located within the concentrically formed vent passage 64, and is located adjacent these openings 66, but the vapor pressure generated within the spout, as the fuel is being dispensed, will likewise have access into the vent tube 63. Thus, these vapors likewise have access into the area of the nozzle diaphragm, as to be subsequently described. See also FIG. 1A for disclosing the relationship of the nozzle spout 18, the inner cylinder 64A, the vapor return path or passage 64, in addition to the location of the vent tube 63.

To summarize, it is through the inner concentric flow path 65 that the fuel being dispensed flows for delivery to the vehicle tank T. The fumes and vapors generated while fuel is being dispensed are allowed to flow into the openings 66, and pervade within the vent passage 64, for return back through the nozzle body, and returned to the underground storage tank, for capture and retention, so as to prevent their escape to the atmosphere. In addition, the same vapors generate a partial pressure, as a result of the flow of fuel, enter into the vent tube 63, at its end 67, and this partial pressure, as generated, passes through the said tube 63, through various passages, such as the one shown at 69, for movement through the aforesaid air passage 62, and into the influence of the nozzle diaphragm, to provide for automatic shut-off, when the fuel being dispensed has filled to capacity the tank T, as known in the art.

When tank T is substantially full, it is desirable to terminate flow of fuel through the nozzle so to not overfill the tank. For this purpose, as is also known in the art, plunger 38 extends upwardly and into a circular cavity 88 in body 12. While the lower end of the plunger is attached to lever 34, the upper end of the plunger is attached to a diaphragm assembly 74. An opening 86 is formed in upper face 77 of the nozzle body (as viewed in FIG. 1) and a circumferential shoulder 78 extends thereabout. The outer margin of a circular diaphragm 80 is captured between this shoulder and the base 82 of a cap 84 which is retained in the opening. The diaphragm and cap together define the chamber 86. One end of air passage 62, as previously defined, as shown in FIG. 1, opens into this chamber 86, as can be seen at 85.

Figure 8:
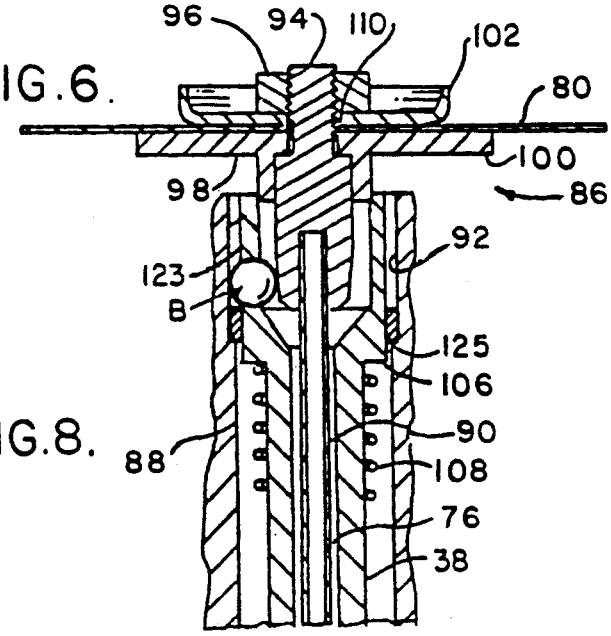
FIG. 8 is an enlarged view of the vapor shut-off mechanism of this invention.

Plunger 38 has a longitudinal, central bore 76 extending from the upper end thereof partially through the length of the plunger. (See also FIG. 8) Fitting in this bore is a stem 90. Attached to the upper end of the stem is a latch pin assembly 94. Diaphragm 80 has a central opening 110 through which the upper end of the latch pin assembly extends. A nut 96 fits onto this end of the hub to capture the diaphragm on the latch pin assembly. On the underside of the diaphragm is a circular backing plate 98 having an annular flange 100 which fits over the hub assembly. A second backing plate 102 fits on the other or top side of the diaphragm between the nut and the diaphragm. Backing plate 102 also acts as a seat for bias spring 104, the other end of which seats against the upper inner face of cap 84. The force of spring 104 urges the latch pin downwardly, via the diaphragm assembly. The plunger has a shoulder 106 (see FIGS. 1 and 8) formed in its outer wall, at the upper end of the said plunger. Three equally spaced apart openings or slots 123 (only one of which is shown in FIGS. 1 and 8) are formed in the upper expanded end of plunger 38. These slots extend from the upper end of the plunger downwardly to a joint above shoulder 106. A ball B is fitted in each slot, the balls being retained by the wall defining cavity 92 and by the latch pin assembly 94.

A spring 108 seats against shoulder 106, and the bottom wall of cavity 88 to urge plunger 38 upwardly. Fitting between the plunger and the sidewall of the cavity, at a point immediately above the shoulder is a latch ring 125. The upper surface of the latch ring is conical in shape. When lever 34 is grasped by the user of the nozzle, plunger 38 is held in place by balls B. This is because the balls are pushed outwardly by the latch pin assembly against the conical surface of the latch ring. As a consequence, lever 34 pivots about lever pin 40.

The force exerted by the user on the lever is sufficient to overcome the force of spring 22 so the outer end of the lever, gripped by the user, is pulled upwardly (as viewed in FIG. 1), this movement also serving to open valve 20.

Figure 5:
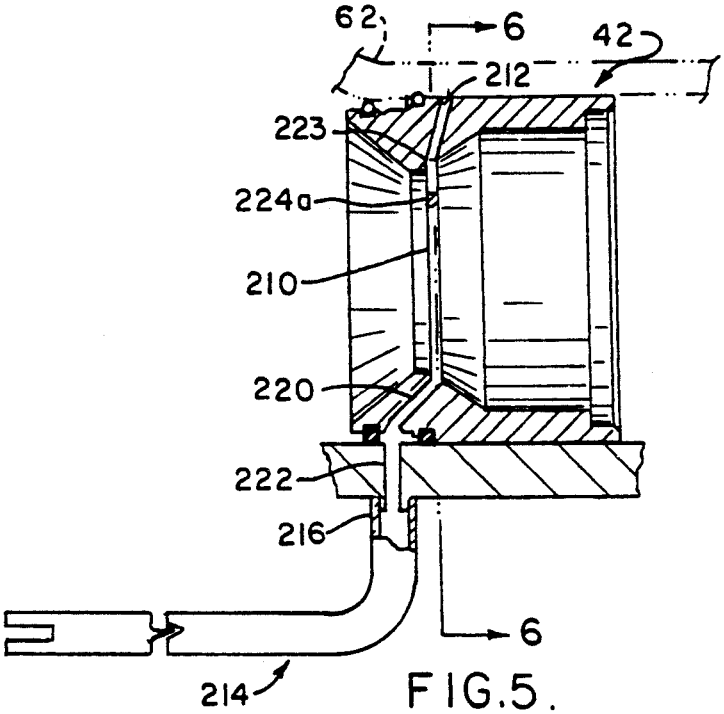
FIG. 5 is a sectional view of the variable venturi portion of the nozzle assembly including the improvement of the present invention.

Referring to FIG. 5, variable venturi 42 produces a partial vacuum that is communicated to chamber 86, also via passage 62. For this purpose, an annular groove 210 is formed in the inner sidewall of the venturi at the approximate narrowest diameter portion of the venturi. A port 212, or sets of ports, comprises a passage extending through the body of the venturi, orthogonal to the centerline thereof. One end of the passage opens into the groove 210, and the other end eventually into passage 62. The partial vacuum created by the rush of fuel through the neck of the venturi, and applied to the one side of diaphragm 80, is further partially reduced by the vapors also flowing in the return mode through the passage 64 passing by the entrance of vent tube 63. As tank T fills, the level of fuel in the tank rises, until it eventually blocks the entrance openings 66 at the spout, eliminating this additive air pressure. As this occurs, the partial vacuum generated in the chamber 86 increases. When the vacuum becomes sufficiently strong, the vacuum force overcomes the effect of spring 104 and the latch pin assembly is drawn upwardly. This allows plunger 38 to now move downwardly, under the force of the spring 22 upon the stem 26 and upon the operating lever 34. Spring 22 is then free to push valve 20 against its seat to stop fuel flow through the nozzle. Then lever 34 is released, spring 108 urges plunger 38 once again upwardly. The force of this spring is sufficient to overcome the force of spring 104. This allows balls B to raise past the latch ring 125 with latch pin 94 being fully extended into plunger 38, in preparation for the next dispensing function. This is known in the art.

The further essence of this invention is to provide for means for returning fuel vapors back to the storage tank, and in addition, to provide means for extracting the condensed vapors, or accumulated fuel, from the vapor return line, so as not to block its effectiveness in operation. Initially, the fuel passes through a passage 130 provided along the right side of the fuel nozzle, as can be seen in FIG. 1, and flows along a conduit, integrally formed within the handle body, as at 131. The fuel then passes by means of an opening into the chamber 133, wherein the poppet valve 20 locates. When the poppet valve 20 opens, as upon its rising above the valve seat 24, fuel passes into the opening 135 for passage around the stem housing 136, for forcefully biasing against the check valve 43, lifting it from its valve seat, for movement through the fuel passage 65, for dispensing from the end 19 of the spout. This is well understood from prior devices.

Simultaneously, the opposite side of the handle housing 10, as can be seen in FIG. 2, likewise provides a path for communication with the vapor return passage 64, the vapors pass a valve means 140, which will be subsequently described, and when the valve means 140 is open, the vapors are then allowed to pass through an integral channel, as at 141, formed along the left side of the nozzle housing, for communication into a concentrically formed or dual hose, wherein the vapors passing through the passageway 141 enter into a vapor return passage, formed of the hose, while the interior or inner concentric portion of the hose provides for flow of the fuel when being dispensed, as known in the art. Usually, a pump associated with the dispenser will be drawing the vapors back to the storage tank.

The second aspect of vapor return, as alluded to above, is to eliminate any problems that may be associated with the condensation of vapors, which may accumulate within the vapor return path particularly of the hose, and this is achieved in this particular invention as follows. An extraction path for condensed fuel vapors which are created during a filling operation includes an extraction hose 214, one end of which communicates with venturi port 220, the other end of which is routed through the vapor return path of the coaxial or concentric hose, eventually ending at a position where condensed fuel vapors will rest. This vapor return path 141, as previously stated, as is commonly provided integrally through the nozzle housing, extends through to the fuel hose, returns vapors back to the underground tank. But, where the fuel hose has a lower dip or loop disposed towards the ground, condensed vapors do accumulate. This is the area in the vapor return line where the extraction hose 214 ends, and sucks in the condensed vapors, returning them to the fuel flowing through the nozzle.

As stated, it sometimes happens that the fuel vapors begin to condense in the vapor return hose that connects at 14 to the nozzle. This condensate, if not removed, can descend to the lowermost position in the fuel line hose, and can block the vapor recovery line, prevent the vapors from being returned, and the vapors once again may escape to the atmosphere. To facilitate recovery, even if condensation occurs, a second vacuum is produced at the variable venturi 42 and applied to the end of this tube 214.

Figure 6:
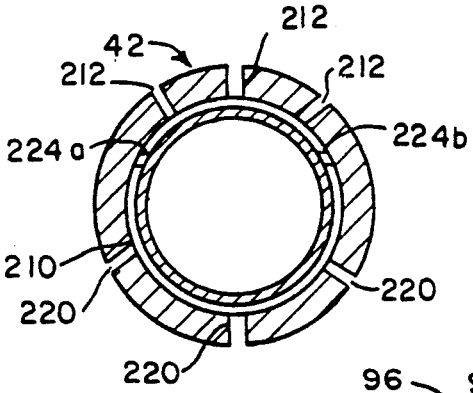
FIG. 6 is a sectional view taken along the line 6—6 in FIG. 5.

As can be seen once again in FIGS. 5 and 6, a second port 220, or sets of ports, which are generally opposite ports 212, comprise a passage extending through the body of the venturi. A bore 222 extends through the sidewall of the nozzle body. Nipple 216 is formed at the outer end of the bore. The inner end of the bore is in fluid communication with the outer end of ports 220, so the second vacuum can be applied to the one end of hose 214. See also FIG. 2. To create the second vacuum, ridges 224*a*, 224*b* extend across the width of groove 210. The ridges are formed on the respective portions of the groove extending between the two sets of ports. Thus, the portion of the groove extending from the respective one side of the ridges is used to create the first vacuum, for assisting in effecting operations of the diaphragm 80, and the portion of the groove on the other or lower shown side of the ridges produces the second vacuum, for operations of the said condensed vapor return means. As such, the ridges effectively isolate the two vacuums from one another. This is important because it means condensed fuel vapors can be recovered without the need of additional devices, and all achieved automatically through the naturally developed partial vacuums generated within the operating nozzle.

It will be understood that groove 210 could be omitted and that ridges 224*a*, 224*b* could extend across venturi throat at approximate 223, to isolate or separate the generated partial vacuums. It will also be understood that if the ridges were not present, the vacuum created by the variable venturi could be applied both to passage 62, and to the one end of hose 214. There would then be a vacuum communication between ports 212 and 220. This would balance out the applied vacuums. As a result the nozzle assembly would not be able to lift a required height of fuel, or, the assembly would automatically shut-off fuel flow each time fuel entered the vapor recovery hose. By isolating the two vacuums, the vacuum required for operation of the shut-off mechanism is not effected by the presence of condensate in the recovery line, or its removal through usage of the partial vacuum. At the same time, fuel at a depth below the nozzle can be extracted from a vapor return hose during a normal filling operation. All the standard check valve 43 and venturi 42 operations are maintained, including anti-siphoning, creation of a positive vacuum at both low and high flow rates, and minimal back pressure.

Figure 7:
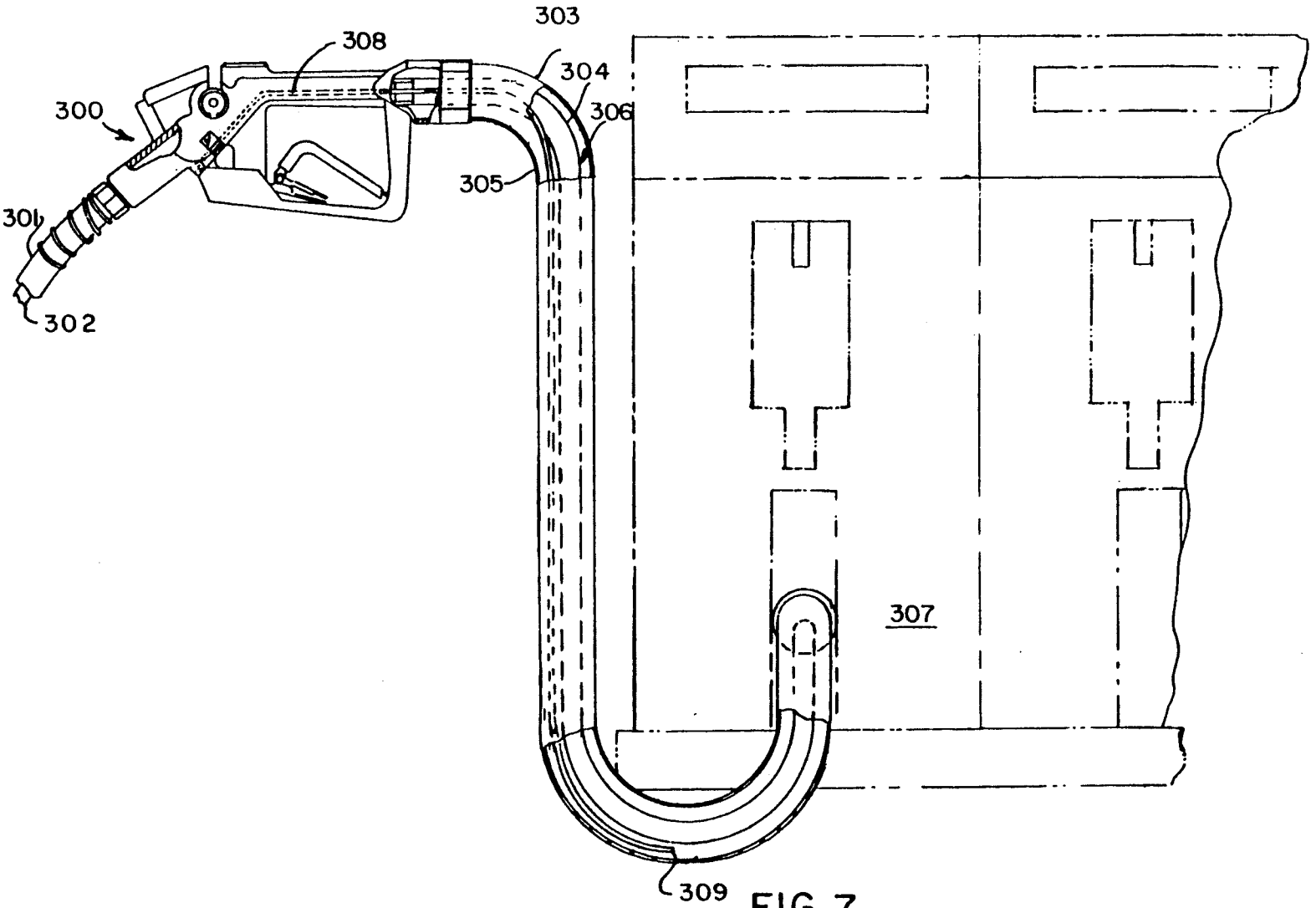
FIG. 7 is a schematic view of the nozzle, of the vacuum assist type, connected by its fuel line to the dispensing pump, and disclosing means for removing of condensed vapors from within the vapor return line of the concentrically formed fuel line, incorporating vapor recovery.

A further example, to illustrate the principle of this invention, of the usage of this concept for removal of condensed vapors within a fuel line is shown in FIG. 7. As disclosed, in this particular instance, the nozzle 300 is of the vacuum assist type of system, as aforesaid, wherein the spout 301 includes an inner spout 302, just as the previously defined spout 18 and its cylinder passage 64, respectively, and through which the fuel flows, with the space between the concentric spout 301 and 302 providing a narrow passage through which the vapors are drawn into the nozzle, for recovery and accumulation, and returned back to the underground storage tank, as previously explained. In this particular instance, the nozzle incorporates its vapor return line entirely through the nozzle, as by furnishing a passage along one sidewall of the same, as aforesaid, and the vapor return line communicates with the concentrically formed fuel line 303, as can be seen. For example, the fuel passes through the fuel line 303 by pumping through its inner hose 304, while the outer hose, or bellows or outer concentric formed hose 305, arranged exteriorly thereof, provides a passage, as at 306, through which the vapors are returned back to the dispensing pump 307, and are eventually pumped back to the underground storage tank. In this particular instance, where the concentric form of spout designed nozzle 300 is employed, a vacuum pump at the dispenser is used to attract the vapors back into the spout 301, in the manner as previously explained. In this particular invention, though, the condensed vapor return line 308, corresponding to the line 214, as previously explained, connects at the same position proximate the attachment of the previously explained hose 214 at the location of the passage 222, within the nozzle. In this particular instance, the vapor condensation return line 308 is in communication with the passage 220, through the venturi 42, and the hose extends also through the vapor passage return, as previously explained, integrally formed through the nozzle 300, with the line further extending into the vapor return passage 306, of the fuel hose 303, and is disposed downwardly, as noted at 309, for terminating at an approximate lowermost position of the fuel line 303. It is at this position where the condensed vapors accumulate as a liquid, and need to be removed, otherwise if the accumulation of the condensed vapors, in the form of a liquid, becomes too excessive, it totally blocks the vapor return passage 306, and at the same time, causes a discharge of vapors to atmosphere.

Figures 3, 4:
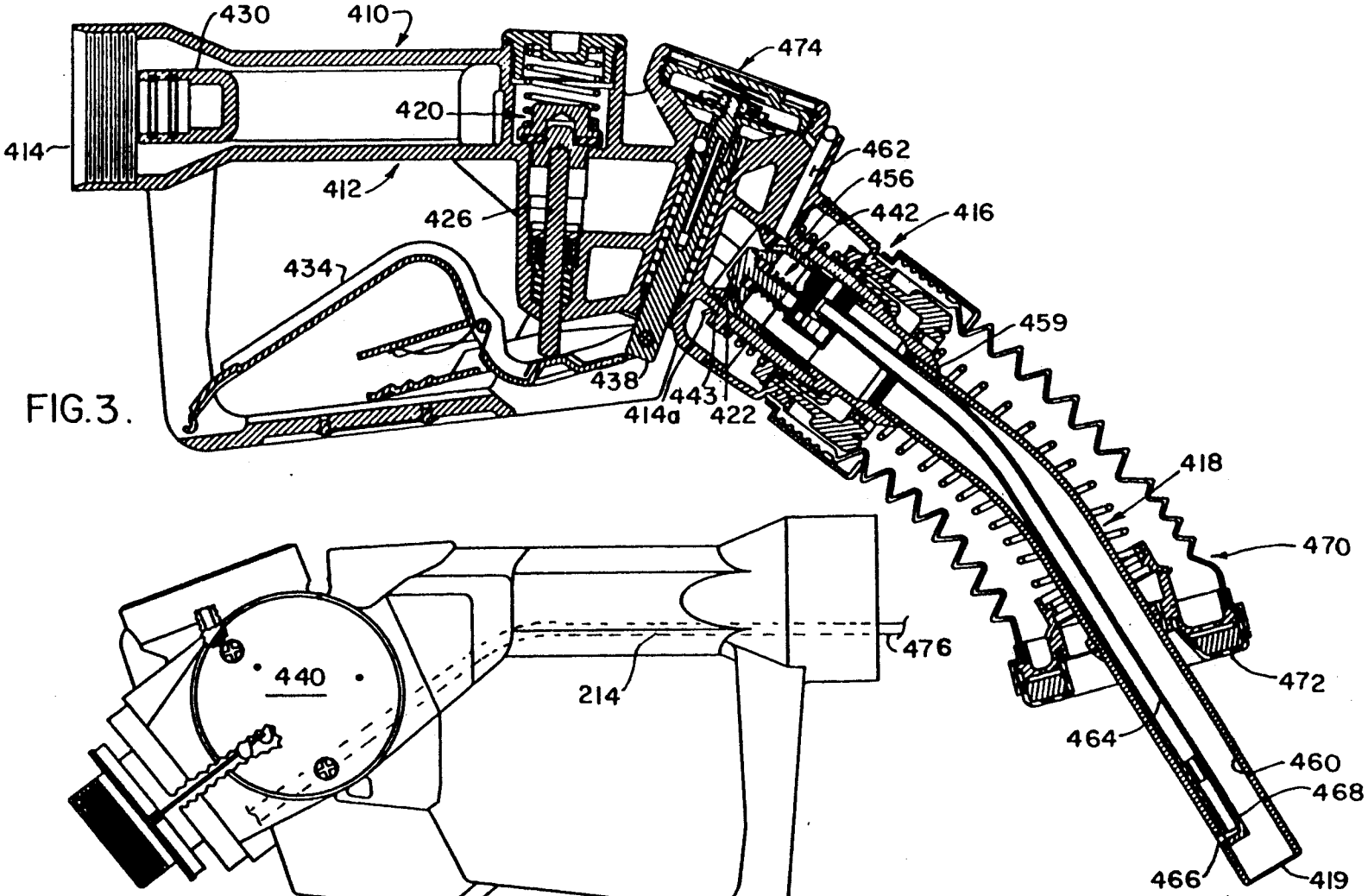
FIG. 3 is a sectional view of a nozzle assembly of the balanced pressure system type embodying the improvement of the present invention.
FIG. 4 is an opposite side view of the nozzle assembly, without the spout attached, as shown in FIG. 3.

The depiction of the condensed vapor return line 308, as shown in FIG. 7, is an example of the form of return line that may be used in conjunction with the various nozzles of this invention, and whether it be of the concentric spout type, as shown at 301, or the bellows constructed balanced pressure type of nozzle spout, as shown in FIG. 3. In any event, and regardless whether the condensed vapor line is formed integrally within the nozzle, as shown at 308, or extends by means of a hose 214 from the venturi, and upwardly into the nozzle, proximate its entrance end 14, for locating within the vapor return passage 306, the condensed vapor return line is intended to function in conjunction with the generated partial vacuum, for withdrawing the condensed vapors out of the fuel line, and transmits it back into the course of the flowing fuel, as through the venturi 42, and to the nozzle spout, to be dispensed.

The valve means 140, as previously explained with respect to FIG. 2, is rendered operative by means of fluid pressure that compresses within a chamber of the valve, while fuel is passing through the nozzle and being dispensed. That opens up its valve to allow for the return of vapors back into and through the nozzle and to the hose, as aforesaid. Obviously, some type of pumping means normally is employed with the dispenser, or the storage tank, in order to assure that vapors are fully returned back to the underground storage tank. On the otherhand, when the nozzle ceases the dispensing of fuel, as when fuel has risen to the full level within the vehicle fuel tank T, and the nozzle shuts off, it then becomes necessary to close off the valve means 140, so as to capture those vapors already returned to the dispenser and storage tank, and to block their escape to the atmosphere, as when the nozzle is inoperative, and not being used to dispense fuel. Hence, spring means provided in the vapor return valve means causes a closure of said valve 140, after the pressure from the flowing fuel is curtailed, in order to assure that the valve means returns into sealed closure, and sustains the capture of the returned vapors, to maintain their retention.

The utilization of the concept of this invention within the balanced pressure system is more aptly disclosed in FIGS. 3 and 4. As can be seen, the nozzle includes its body 412, its inlet 414, to which the fuel hose is connected. The nozzle has an outlet 416, communicating with a spout assembly 418. The assembly 418 has a mouth 419 that is inserted into the inlet of the container such as the automobile fuel tank T as previously explained. Disposed within the body 412 is the poppet valve 420. This poppet valve 420 is operative in the manner as previously explained, with respect to the previously defined partial vacuum assist system. Adjacent the outlet 416 of the nozzle, is the fuel path through the body 412, and locates the variable venturi 442, equivalent to the venturi 42 as previously explained. It includes its check valve 443, that functions in a similar manner. The venturi 442 is installed within the circular housing 456, as noted.

Spout assembly 418 includes a spout housing 459, the spout 418 extending forwardly thereof, as noted. Within the interior of the spout 418 is the flow path, 460, through which the fuel being dispensed flows.

The air passage 462 is integrally formed within the nozzle body 412 and communicates via various passages with the inner end of the vent tube 464, which fits within the spout 418. This vent tube is of a much smaller diameter than the spout 418, for the vent tube to fit within said spout, and has a length that is less than the spout so that the vent tube terminates short of the mouth 419, of the said spout. An opening or air hole 466 is formed at the outer end of the spout adjacent its mouth. The outer end 468 of the vent tube is located adjacent this opening so air flowing into the spout through the opening flows into the vent tube.

A bellows assembly 470 fits over the spout assembly. The bellows assembly is designed for use with the nozzle to help prevent fuel vapors from escaping into the atmosphere when gasoline or a similar fuel is being dispensed into the tank. This bellows type operates under the balanced pressure method, as foresaid. A detailed description of a bellows assembly such as the assembly 470 may be found in U.S. Pat. Nos. 4,031,930 and 4,016,910, which are assigned to the Husky Corporation, the same assignee as that of this present application. It will be understood, however, that assembly 470 has an outer seal end 472, which abuts against the periphery of the tank inlet to sealingly fit thereagainst. This seal 472, along with the bellows 470, ride up or down with respect to the spout 418, as the spout is inserted into the fuel tank T, in preparation for fuel dispensing. The function of the bellows assembly is to entrap fuel vapors which would otherwise escape into the atmosphere when the spout is inserted into or removed from the inlet.

In the operations of the nozzle 410 of this invention, the functions of its plunger 438, its lever 434, and its poppet stem 426, are equivalent to that as previously explained with respect to the earlier described nozzle. The variable venturi 442, and its locating and positioned within the nozzle outlet 416, is of identical construction to the venturi as previously described in FIGS. 5 and 6. Thus, it is the combination of the partial vacuum generated through the vent tube 464, that communicates with the air passage 462, in addition to the partial vacuum generated in the upper section of the venturi 42, through its ports 212, that provide for the functioning of the shut-off diaphragm 474. In addition, the vapors absorbed within the bellows assembly 470, that pass the vapors through the integral chamber formed along the left side of the nozzle housing 410, returns the vapors back to the concentric and dual hose (not shown) that connects with the back end of the nozzle 414, and returns the vapors back to the underground storage tank. A check valve, as at 440, functions in a manner similar to the valve means 140, as previously explained. In addition, the fuel flows through the nozzle housing 410, by passage through the integral chamber 430, and through the poppet 420, for directing the pumped fuel through the valve 443, when dispensing the fuel.

In addition, the partial vacuum generated within the venturi 442, which develops a partial vacuum through the lower ports 220, as in FIGS. 5 and 6, communicates with the port 422, and through its nipple **414*a* attaches with the extraction hose 214, as aforesaid, which extends towards the rear of the nozzle at 476, as can be seen in FIG. 4, for connection with a condensed fuel flow tube, equivalent to that as shown at 309, for extracting condensed vapors from the lowermost region of the concentric hose, similar to that as previously explained with respect to FIG. 7. Thus, regardless whether the nozzle utilized is that of the balanced pressure system, incorporating the bellows type of vapor recovery, as shown at 470, or is of the vacuum assist type, generated by the development of a partial vacuum that has a tendency to attract vapors back into the nozzle, as explained with respect to the description of FIGS. 1 and 7**, the concept of this invention for extracting condensed vapors from within the fuel hose, to achieve the desired results, can be attained in either case.

In view of the foregoing, it will be seen that the several objects of the invention are achieved and other advantageous results are obtained. As various changes could be made in the above construction without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. In a nozzle assembly for dispensing fuel from a source thereof into a container such as a fuel tank, the assembly having a body in which is defined a fuel flow passage, a spout attached to the body and in fluid communication therewith for directing fuel into the tank, a variable venturi capable of providing for the unified flow of fuel therethrough, said variable venturi interposed in the passage for producing a partial vacuum which is used to automatically shut-off fuel flow when the tank is full, and a vapor return path for capturing fuel vapors and returning them to the source, said vapor return path susceptible of inadvertently accumulating fuel at a low point, the improvement comprising, means for extracting fuel from the vapor return path, said means including means for generating a second vacuum at the variable venturi which is applied to the location of the vapor return path to draw any fuel out of the path, the assembly including an extraction means, one end of which is in fluid communication with the variable venturi and capable of conducting the second vacuum generated therein, the variable venturi having at least one port therein defining a vacuum generation area for generating the second vacuum therein, and the extraction means includes at least one passage extending through the venturi and opening to the vapor return path at the location of the fuel, there being at least one second port extending through the venturi and opening into another passage, said at least one second port allowing the partial vacuum created by the venturi to be communicated to that portion of the assembly controlling automatic fuel flow shut-off, said variable venturi including means for isolating the produced partial vacuum and the second vacuum while allowing the unified flow of fuel therethrough for its dispensing into a tank, said variable venturi incorporating a circumferential groove formed therein defining a vacuum generating area, said one port and said second port communicating with said circumferential groove, and said one port and said second port extending through the venturi and communicating, respectively, with the vapor return path, and that portion of the assembly controlling automatic fuel flow shut-off.

2. The invention of claim 1 wherein the extraction means includes a pair of ridges formed in the venturi circumferential groove intermediate the said one port and the said second port, said ridges forming the groove into two portions, whereby the partial vacuum created in one portion of the groove is directed to the fuel flow shut-off portion of the assembly, and the second vacuum created in the other portion of the groove is communicated to the vapor return path to extract fuel.

3. The nozzle assembly of claim 2 wherein the vapor return path includes an extraction hose, one end of which is in fluid communication with the said one port.

4. The invention of claim 3 and further including said variable venturi having a narrow diameter portion unobstructed for providing unified flow of the fuel therethrough, said circumferential groove being located on the downstream side past the narrow diameter portion of the variable venturi, said ridges being formed in the groove to provide for isolation of the produced partial and second vacuums at the second and first ports respectively thereof, to isolate the produced vacuums at the one port and the said second port for providing for directing the produced vacuums respectively to the fuel flow shut-off portion of the assembly and for the extraction of fuel.

5. The invention of claim 4 and wherein said nozzle assembly incorporating the variable venturi and its cooperating ports for producing the partial and second vacuums may be used in conjunction with a nozzle assembly incorporating vapor recovery means of one of the balanced pressure system type and the vacuum assist system type.

6. In a nozzle assembly for dispensing fuel from a source thereof into a container such as a fuel tank, the assembly having a body in which is defined a fuel flow passage, a spout attached to the body and in fluid communication therewith for directing fuel into the tank, a variable venturi capable of providing for the undivided and unified flow of fuel therethrough, said variable venturi interposed in the passage for producing a partial vacuum which is used to automatically shut-off fuel flow when the tank is full, and a vapor return path for capturing fuel vapors and returning them to the source, said vapor return path susceptible of inadvertently accumulating fuel at a low point, the improvement comprising, means for extracting fuel from the vapor return path, said means including means for generating a second vacuum at the variable venturi which is applied to the location of the vapor return path to draw any fuel out of the path, the assembly including an extraction means, one end of which is in fluid communication with the variable venturi and capable of conducting the second vacuum generated therein, the variable venturi having at least one port therein defining a vacuum generation area for generating the second vacuum therein, and the extraction means includes at least on passage extending through the venturi and opening to the vapor return path at the location of the fuel, there being at least one second port extending through the venturi and opening into another passage, said at least one second port allowing the partial vacuum created by the venturi to be communicated to that portion of the assembly controlling automatic fuel flow shut-off, and said variable venturi including means for isolating the produced partial vacuum and the second vacuum while allowing the undivided and unified flow of fuel therethrough for its dispensing into a fuel tank.

7. Means for generating a plurality of partial and isolated vacuums in the venturi of a nozzle assembly while maintaining an undivided and unified flow of a fuel through the nozzle venturi and for dispensing said fuel from a fuel source into a fuel tank, the nozzle assembly having a body in which is defined a fuel flow passage, a spout attached to the body in fluid communication therewith for directing fuel into the tank, said venturi locating at the spout-nozzle juncture, said nozzle incorporating means for automatically shutting-off fuel flow when the tank is full, and said nozzle incorporating a vapor return path for capturing fuel vapors and returning them to the source to reduce air pollution, said vapor return path susceptible of inadvertently accumulating fuel at a low point, said venturi of the nozzle assembly comprising a variable venturi also interposed in the fuel passage of the nozzle assembly, said variable venturi disposed for providing for the undivided and unified flow of fuel therethrough, structural means formed on the venturi for creating a first partial vacuum supplied to the automatic shutting-off means, and said structural means provided for creating a second partial vacuum applied to the vapor return path to draw fuel out of the said path, and there being means formed of the variable venturi to isolate the created first and second partial vacuums during the undivided passage of the flow of fuel through the nozzle body, its variable venturi, and for its dispensing from the spout.

* * * * *

UNITED STATES PATENT AND TRADEMARK OFFICE

CERTIFICATE OF CORRECTION

PATENT NO. : 5,197,523

DATED : March 30, 1993

INVENTOR(S) : Arthur C. Fink, Jr., et al.

It is certified that error appears in the above-identified patent and that said Letters Patent is hereby corrected as shown below:

Claim 6, column 12, line 14, "on" should be

---one---.

Signed and Sealed this

Eighteenth Day of January, 1994

*Attest:*

Bruce Lehman

BRUCE LEHMAN

*Attesting Officer*

*Commissioner of Patents and Trademarks*